US006450498B1

(12) United States Patent
Rombone

(10) Patent No.: US 6,450,498 B1
(45) Date of Patent: Sep. 17, 2002

(54) MILITARY STRATEGY GAME

(76) Inventor: Michael Rombone, 18 Chatham Rd., Hewitt, NJ (US) 07421

( * ) Notice: Subject to any disclaimer, the term of this patent is extended or adjusted under 35 U.S.C. 154(b) by 0 days.

(21) Appl. No.: 09/871,794

(22) Filed: Jun. 1, 2001

(51) Int. Cl.[7] ..... A63F 3/00
(52) U.S. Cl. ..... 273/255; 273/262
(58) Field of Search ..... 273/255, 262

(56) References Cited

U.S. PATENT DOCUMENTS 3,831,944 A 8/1974 Upton
4,415,160 A 11/1983 Lamb
4,733,870 A 3/1988 Rinehart
5,026,069 A * 6/1991 Leask ..... 273/255
5,388,837 A * 2/1995 Hoffman ..... 273/262
5,803,455 A 9/1998 Falzarano

* cited by examiner

*Primary Examiner*—Benjamin H. Layno
*Assistant Examiner*—V K Mendiratta
(74) *Attorney, Agent, or Firm*—Goldstein & Lavas, P.C.

(57) ABSTRACT

A military strategy game where each player takes turns drawing cards and rolling a twenty sided die to acquire money to purchase armed forces strong enough to defeat their opponents armed forces. The player who defeats their opponents armed forces first, wins.

1 Claim, 2 Drawing Sheets

MILITARY STRATEGY GAME

BACKGROUND OF THE INVENTION

The present invention relates to a military strategy game and more particularly pertains to strategizing in order to defeat an opponent.

The use of games for amusement purposes is known in the prior art. More specifically, games for amusement purposes heretofore devised and utilized for the purpose of providing amusements for participants are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,733,870 to Rinehart discloses an economic and political strategy board game using various cards, and monetary units. U.S. Pat. No. 5,803,455 to Falzarano discloses a military game using a number of cards and dice. U.S. Pat. No. 3,831,944 to Upton and U.S. Pat. No. 4,415,160 to Lamb disclose various conflict related strategy games.

While these devices fulfill their respective, particular objective and requirements, the aforementioned patents do not describe a military strategy game for strategizing in order to defeat an opponent.

In this respect, the military strategy game according to the present invention substantially departs from the conventional concepts and designs of the prior art, and in doing so provides an apparatus primarily developed for the purpose of strategizing in order to defeat an opponent.

Therefore, it can be appreciated that there exists a continuing need for a new and improved military strategy game which can be used for strategizing in order to defeat an opponent. In this regard, the present invention substantially fulfills this need.

SUMMARY OF THE INVENTION

In the view of the foregoing disadvantages inherent in the known types of games for amusement purposes now present in the prior art, the present invention provides an improved military strategy game. As such, the general purpose of the present invention, which will be described subsequently in greater detail, is to provide a new and improved military strategy game which has all the advantages of the prior art and none of the disadvantages.

To attain this, the present invention essentially comprises a military strategy game where each player takes turns drawing cards and rolling a twenty sided die to acquire money to purchase armed forces strong enough to defeat their opponents armed forces. The player who defeats their opponents armed forces first, wins.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved military strategy game which has all the advantages of the prior art games for amusement purposes and none of the disadvantages.

It is another object of the present invention to provide a new and improved military strategy game which may be easily and efficiently manufactured and marketed.

It is a further object of the present invention to provide a new and improved military strategy game which is of durable and reliable construction.

An even further object of the present invention is to provide a new and improved military strategy game which is susceptible of a low cost of manufacture with regard to both materials and labor, and which accordingly is then susceptible of low prices of sale to the consuming public, thereby making such a military strategy game economically available to the buying public.

Even still another object of the present invention is to provide a new and improved military strategy game for strategizing in order to defeat an opponent.

Lastly, it is an object of the present invention to provide a new and improved military strategy game where each player takes turns drawing cards and rolling a twenty sided die to acquire money to purchase armed forces strong enough to defeat their opponents armed forces. The player who defeats their opponents armed forces first, wins.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
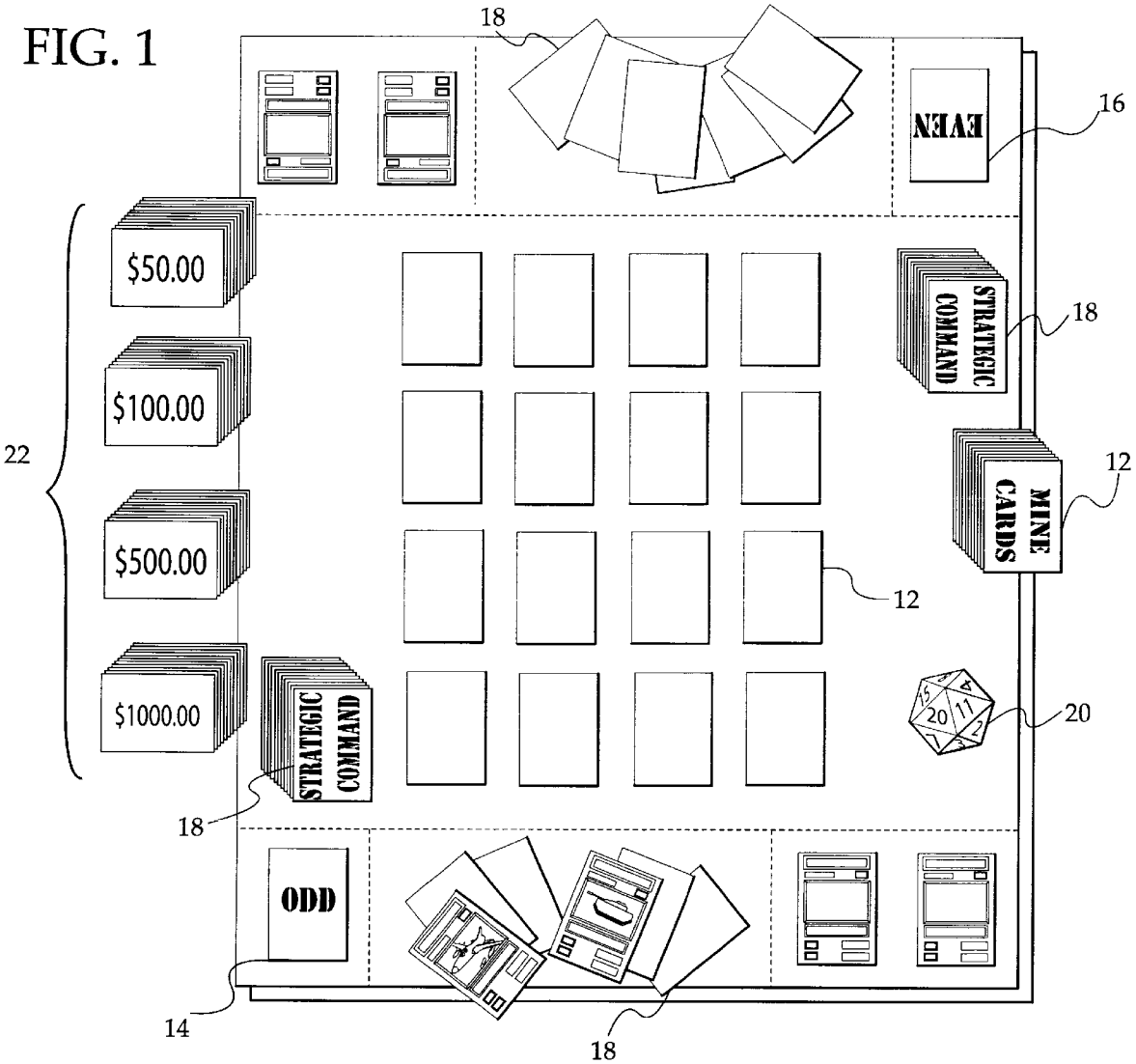
FIG. 1 is a perspective view of the preferred embodiment of the military strategy game constructed in accordance with the principles of the present invention.
Figure 2:
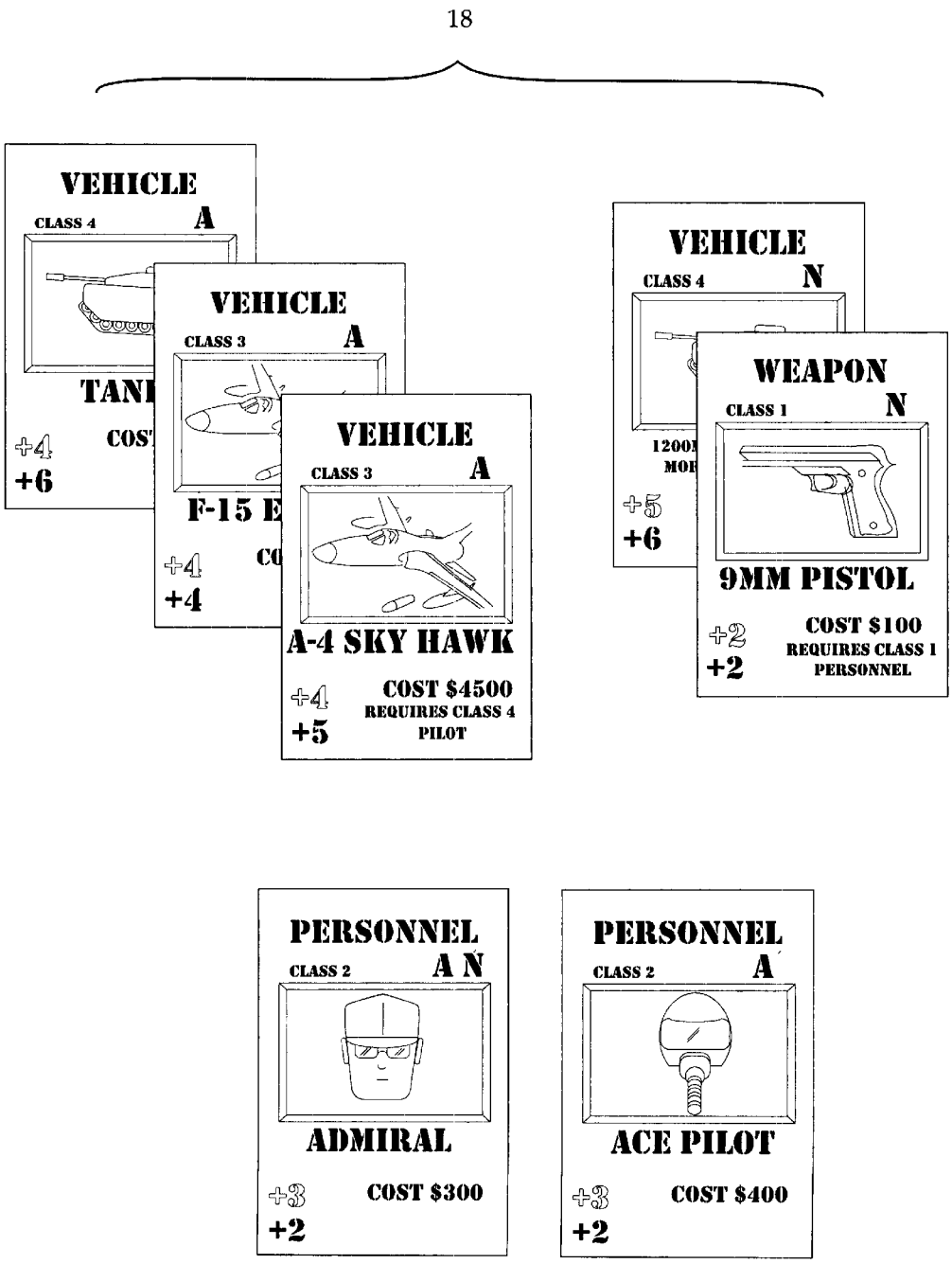
FIG. 2 is a perspective view of the game cards of the present invention.

With reference now to the drawings, and in particular, to FIGS. 1 and 2 thereof, the preferred embodiment of the new and improved military strategy game embodying the principles and concepts of the present invention and generally designated by the reference number 10 will be described.

Specifically, it will be noted in the various figures that the device relates to a military strategy game for strategizing in order to defeat an opponent. In its broadest context, the device consists of identifier cards, mine cards, a twenty sided die, a set of money, and game cards. Such components are individually configured and correlated with respect to each other so as to attain the desired objective.

The game is clearly illustrated in FIG. 1. The mine cards 12 are positioned on a table or other recipient surface in a manner illustrated in FIG. 1. The remaining mine cards 12 are placed to the side. The two players are given either an "odd" card 14 or an "even" card 16. The game cards 18 are distributed to the players in the manner described in greater detail hereinafter. The remaining game cards 18 are placed to the side. The game cards 18 are further illustrated in FIG. 2. The twenty sided die 20 is used to determine order of play. The set of money 22 is organized in a manner to facilitate distribution to the players.

The present invention can be better understood by a detailed description of the rules following hereinafter.

The game is set up by separating the "odd" and "even" of cards from the rest of the cards and place them, facing up next to each of the players. Shuffle the mine cards and place sixteen of these cards face down in rows and columns of four to create the mine field. The mine field allows both players to build up their forces before either side can attack. Next, both players pick a deck of cards to play with. Both players then search their decks for one class 2 personnel combat card, and one class 3 personnel combat card and places them face up in front of themselves. Both players then shuffle their cards and deal themselves seven cards each. Both players then place their deck's face down. This is referred to as the players draw pile. Both players will roll the twenty side die to see who goes first. Game play may now commence.

A player's turn is broken down into four phase: the draw phase, the action phase, the attack phase, and the mine field phase.

The draw phase is the very first thing a player does on his turn. This is the only phase that is not optional. The first player draws a card from his draw pile. The player is then confronted with several options. He can play the card, he can keep the card, he can discard the card of he can play a different card. If the player decides to keep the card, he places the card in his hand. If the total amount of cards in his hand totals more than seven cards, he must discard to maintain no more than seven cards. To discard, take the unwanted card and place it face up next to the draw pile. This is referred to as the dead pile.

The action phase consists of playing cards that have been drawn during the draw phase and/or cards that are currently held. There are three basic types of cards: combat cards, instant cards, and money roll cards. A player can only play one money roll card per turn. To play a money roll card, the player takes the card either from his hand or the draw pile and places it face up on the table. The player then rolls the twenty sided die and multiplies the result of the die roll times one hundred to receive that amount in cash. This allows the player to accumulate money to purchase personnel, vehicles, and weapons. Once the money roll card has been used, it is discarded to that players dead pile. There are three different categories of combat cards: personnel, vehicle and weapon. Personnel cards must be played first before vehicles and weapons. Vehicles and weapons cannot be played without a personnel card to add them to. The idea being that vehicles and weapons are useless without personnel to operate them. The combat cards each have a category listed at the top. Below the category and to the left is the class rating. The class rating is followed by a number between one and five. A personnel card must have a class rating equal to or greater than a class rating of a vehicle or weapon card in order to operate that vehicle or weapon. Below the category and to the right of the class rating is the organization letter. "N" stands for Navy and "A" stands for Army. Navy personnel can only operate Navy vehicles and weapons. The same being true for Army personnel. Below a central illustration on the card is the title of the card. Below the card's title and to the left are two numbers. One number in white, another in black. The white number is the card's attack value. The black number is the card's defense value. The attack value for a card must be greater than a defense value of another card in order for a successful attack. A matching attach and defense value has no effect. Below the title and to the right is an information box that provides information about the card or special requirements in order to use that particular card. The most information is the cost of the card. These is no-limit to the amount of combat cards a player plays on his turn providing he has the money to pay their costs. To put a combat card into play there are two requirements: you must have the accumulated from your money roll cards to pay the cost of the card or cards and you must start by playing a personnel card. It is not required to put combat cards into play as soon as you get them. You may decide to hole some or all of your combat cards in your hand until you can place them at the same time or just one at a time. To play the combat card, pay the cost that is printed on the card. Then take the card or cards from your hand and place them face up in front of you. Vehicles and weapon's cards must have personnel cards to place on them. It in not a requirement to have vehicle and/or weapon cards placed on them, but it does increase the attack value if you do. All personnel cards are only allowed to have one vehicle and one weapon card placed on them. Once a particular vehicle and/or weapon is placed on a personnel card, these cards stay with this personnel card until this combination is destroyed or the game ends.

The other type of card encountered is the instant card. The instant card may be played at any time during your turn. But you may only use one instant card per turn. Also, any instant cards that are used to attack your opponent may not be used until the mine field has been cleared. To play an instant card, place the card face up on the table and follow the instructions on the card. After and instant card has been played, it is discarded to that player dead pile. On a players action phase, the player may play one instant, one money roll card, and/or as many combat cards as he can afford before his attack phase begins.

The attach phase can only be accomplished if a player plays a money roll card on his action phase and matches either an odd or even roll on the die with the specific "odd" or "even" card that the player possesses. If you possess the "odd" card and roll an even number during your money roll, you still receive that amount of money, but there is no attack ability. Once attack ability has been established, you check your combat cards for total white attack values for each combination of combat cards you have. Then you would check you opponents black defense values that are on his combat cards that are placed in front of him on his side for black defense values less that your attack values. Announce to your opponent that you are attacking that target with your combination. This target is now destroyed and your opponent must remove this target including all cards attached to it and place them face up in his dead pile. The attacking combination cannot be used again until the next turn, but an attack is possible with two other cards or combination of cards. Each attacking combat card or combat card combinations can only attack one of your opponent's combat cards or combat card combinations each.

The mine field phase involves clearing the mine field. To clear the mine field, once per turn a player may send one of his personnel cards through the mine field. To do this, select one of your personnel cards and announce to your opponent that this personnel is attempting to move through the mine field. Next, flip one mine card up. If this mine card is an explosion, then the personnel card is destroyed and is removed from play and placed face up in that players dead pile. The mine card is removed and set aside with the unused mine cards. If the flipped card is a decoy, then your personnel card survives and the decoy mine card is set aside with the unused mine cards. Once a path has been cleared through the mine field, the remaining mine cards in the mine field are automatically removed from play. The mine field has now been cleared and both players can now attack their opponent when given attack ability. This phase of a players turn is completely optional. The player may not have a personnel card that he wishes to sacrifice through the mine field. Additionally, a player may not possess forces strong enough to repel an attack from his opponent when his opponent acquires attack ability. A good strategy in this case would be strengthened your forces before attempting to clear the mine field.

The final object of the game is to eliminate your opponents forces in order to be declared the winner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A military strategy game for strategizing in order to defeat an opponent comprising, in combination:

an "odd" card and an "even" card distributed to two player;

a twenty sided die;

a plurality of mine cards creating a mine field between the two players, the mine cards being either an explosion or a decoy;

a plurality of game cards including combat cards, instant cards, and money roll cards distributed to the two players to create armed forces, the combat cards including personnel cards, vehicle cards, and weapon cards, the game cards can be played by the two players to destroy the mine field and against one another in an attempt to defeat their armed forces, the money roll cards allowing the two players to accumulate wealth; and a set of money distributed to the two players according to the money roll cards to enable the two players to accumulate combat cards.

* * * * *